US005452930A

United States Patent [19]

Morgan

[11] Patent Number: 5,452,930

[45] Date of Patent: Sep. 26, 1995

[54] TAMPER EVIDENT SECURITY DEVICE

[76] Inventor: Brian R. Morgan, 2641 Calle Del Oro, La Jolla, Calif. 92037

[21] Appl. No.: 133,556

[22] Filed: Oct. 7, 1993

[51] Int. Cl.[6] ..... B65D 27/30

[52] U.S. Cl. ..... 292/307 A; 292/307 B; 292/331

[58] Field of Search ..... 292/307 R, 317, 292/320, 307 A, 307 B, 331; 283/98–100; 206/807, 1.5; 40/6, 665, 661

[56] References Cited

U.S. PATENT DOCUMENTS

| | | | |
|---|---|---|---|
| 164,800 | 6/1875 | Brooks | 292/307 R |
| 372,653 | 11/1887 | Boughton | 292/307 R |
| 381,326 | 4/1888 | Brooks | 292/307 R |
| 777,749 | 12/1904 | Russell | 292/907 R |
| 822,945 | 6/1906 | Harris | 292/317 |
| 1,615,057 | 1/1927 | Tyden | 292/307 R X |
| 1,814,773 | 7/1931 | Stillman | 292/307 R |
| 1,952,085 | 3/1934 | Mayer | 292/307 R X |
| 2,002,856 | 5/1935 | Hope | 292/307 R X |
| 2,013,299 | 9/1935 | Byrne | 292/307 A |
| 2,497,434 | 2/1950 | Borland | 292/307 R X |

FOREIGN PATENT DOCUMENTS

| | | | |
|---|---|---|---|
| 537245 | 2/1957 | Canada | 292/317 |
| 2306137 | 12/1976 | France | 292/320 |
| 105481 | 9/1899 | Germany | 292/307 R |
| 642806 | 7/1962 | Italy | 292/320 |
| 273289 | 5/1928 | United Kingdom | 292/307 R |
| 342172 | 1/1931 | United Kingdom | 292/307 R |
| 2051942 | 1/1981 | United Kingdom | 292/307 R |
| 2243139 | 10/1991 | United Kingdom | 292/307 R |

*Primary Examiner*—Frances Han
*Attorney, Agent, or Firm*—Brown, Martin, Haller & McClain

[57] ABSTRACT

A tamper indicating device for use on any container or enclosure has a security strap or other elongate connecting member for securing to between one part of a container or other item and a movable closure for the item, and a base unit for releasably trapping at least one end of the strap so that the container or item cannot be opened without first releasing the strap. The base unit has a recess for releasably retaining the strap end, and an access opening to the recess across which a tamper indicating label can be applied to the base unit. The only access to the recess to release the strap end is via the access opening, and once the label is applied the strap end can only be released by first tearing off or removing the label.

34 Claims, 4 Drawing Sheets

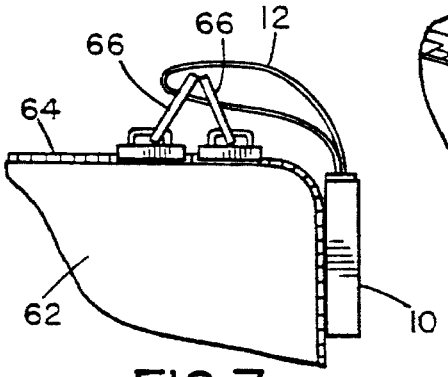
FIG. 7
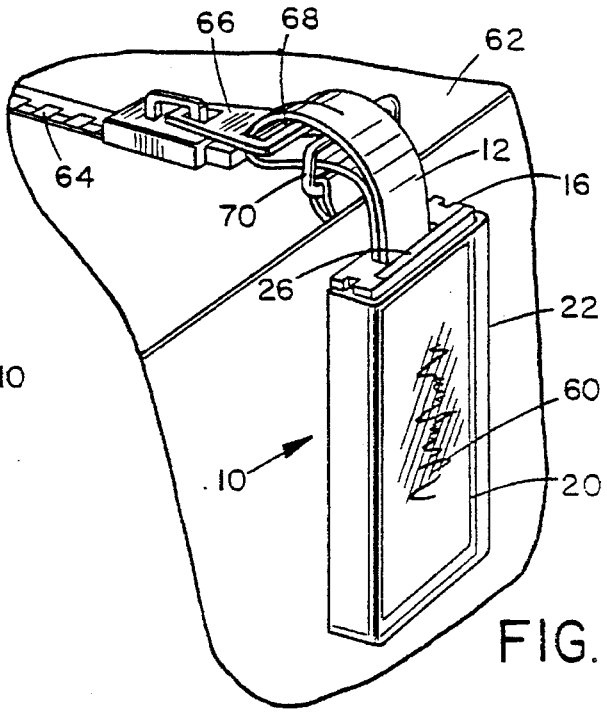
FIG. 6
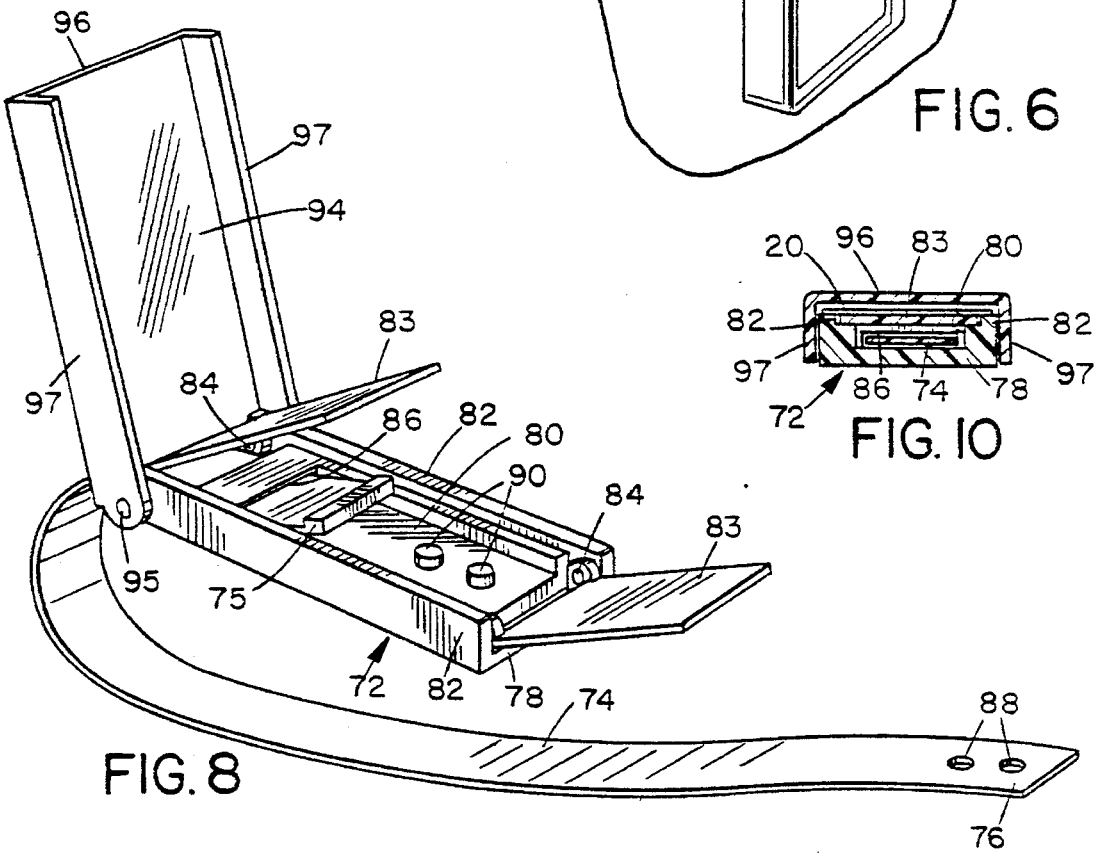
FIG. 8
FIG. 10
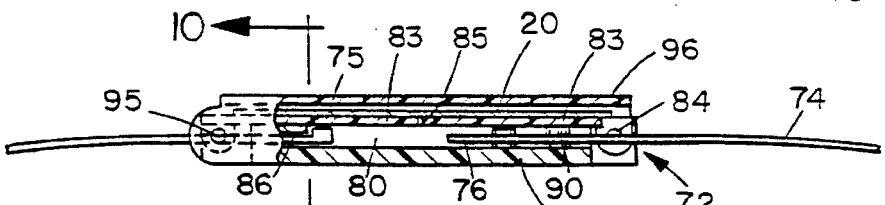
FIG. 9

TAMPER EVIDENT SECURITY DEVICE

BACKGROUND OF THE INVENTION

The present invention relates generally to tamper indicating devices and is particularly concerned with a tamper evident security device for use on luggage, briefcases and other enclosures for containing valuables, personal items, or private or sensitive materials.

In my co-pending applications Ser. No. 07/930,731 filed Aug. 14, 1992 and Ser. No. 07/946,183 filed Sep. 16, 1992, tamper indicating devices are described which involve applying personalized indicia such as a signature to an adhesive strip, and securing the adhesive strip across the closure of a suitcase, briefcase, desk drawer, bottle or other container, such that the container cannot be opened without destroying the strip and/or the indicia.

Simply securing an adhesive strip across the closure line between the lid and base of a suitcase, for example, has distinct disadvantages since strips must be repeatedly secured to the surface of the suitcase. The strips cannot be easily removed after use, and adhesive may remain stuck to the suitcase and detract from its appearance.

SUMMARY OF THE INVENTION

It is an object of the present invention to provide a new tamper indicating security device for use with a case or other container without soiling the surface of the case or container.

According to the present invention, a tamper indicating security device is provided which comprises a strap for extending through a loop on one part of a case or other container, or through a zipper eyelet and lock ring, and a base unit having a trapper for receiving and trapping at least one end of the strap, the other end of the strap either being permanently secured to the base unit or trapped with the first end in the trapper so that the strap cannot be removed without releasing it first from the trapper unit. The trapper or base unit has an access opening for access to the trapper unit, and this may be held closed by applying an adhesive, tamper indicating label across the base unit.

In one embodiment, the base unit has a movable cover portion or lid that may be snapped closed for covering the access opening in a closed position, and the label extends across the closed cover portion and an adjacent portion of the base unit, so that the label extends across the edge of the movable cover portion, which cannot then be moved without tearing the label. The user applies personalized indicia such as their signature or any other unique representation to the label.

Instead of using disposable paper labels, the base unit may have a reusable tamper indicating label secured at one end to the base. This may be of the so-called grease pencil type having a base layer, a transparent upper layer, and an imprinting medium such as grease sandwiched between the layers. The label is laid across the closed movable lid and the user applies pressure with a pencil tip or the like to form an imprint. A transparent lid or the like is then secured across the base to cover the label. If the lid is raised and the label disturbed, the indicia will become partially or completely obliterated.

This device may be used alone with a case or other container having a zipper closure, by closing the zipper and then extending the belt through the zipper pull tab eyelet and the lock ring provided for receiving a padlock or the like at the end of the zipper, if present, or through two adjacent zipper pull tabs. One or both belt ends is then trapped in the base unit, and the signed label is secured across the base unit. The base unit can hang free or may be affixed to the secured item. No one can then open the zipper without first removing the belt end from the base unit, which in turn will tear the label, making the tampering immediately evident to the owner when they return.

The device may also be used on other types of cases having latch closures or the like. A loop or channel unit is secured to one part of the case or container for receiving the belt. The base unit is adapted for securing to the other part of the case or container, for example by providing suitable holes on the base unit for receiving screws, rivets or similar fasteners to secure the base unit permanently to the case. The belt is then extended through the loop unit and one or both ends are trapped in the base unit before applying the label across the base unit to prevent access to the trapped belt end. The positions of the loop and base units and the length of the belt is such that the case cannot be opened without first releasing the belt from the base unit, which in turn involves tearing or destroying the label. The length of the belt can be customized by the user to accommodate the spacial requirements of the container or item being protected. Thus, a user can leave a case or other container for some time and will immediately be able to tell if anyone has opened the case when they return. A supply of labels will be provided for each subsequent use of the tamper indicating device.

Alternatively, two loops or channel units may be secured, one to each part of the case and the belt passed through both loops before trapping its ends in the base unit. In this case, the base unit will hang free.

This arrangement provides an easy and convenient way of preventing others from gaining access to the contents of a container without the owners' knowledge, and will therefore provide a deterrent to anyone attempting to open the container without prior authorization from the owner. The tamper indicating device will be particularly useful when travelling, for example, since it will let the owner know if anyone has opened a suitcase or other case while the case was in transit, or in a hotel room.

The tamper indicating device may be used with any container or item having a movable closure mechanism, including cases, bags, filing cabinets, dressers, cupboards, rooms, and even books. In the case of a room or cupboard, a door may be held closed by attaching one part of the device to the door frame, for example the channel or loop unit, and the other part to the door, for example another channel or the base unit. The belt is then secured between the units and the label applied to the base unit, which is either affixed or hanging free from the straps, thus preventing opening of the item or area without the user's knowledge. If two channels are used, the belt is looped through the channels and the base unit hangs free.

In all cases, the item or area to be protected may be secured either by affixing receiving rings or a loop and/or the base section, one on the solid section and one on the movable closure section, such as a door frame and a door, or the desk frame and the desk drawer. If the base unit is not affixed and two channels or loops are used, then the base unit hangs free by the strap.

BRIEF DESCRIPTION OF THE DRAWINGS

The present invention will be better understood from the following detailed description of some preferred embodiments of the invention, taken in conjunction with the accompanying drawings, in which like reference numerals refer to like parts, and in which:

FIG. 6 illustrates the tamper indicator securing a zipper;

FIG. 7 illustrates the tamper indicator securing two adjacent zipper pull tabs;

FIG. 8 is a perspective view of an alternative tamper indicator in an open position;

FIG. 9 is a side elevation view, partially cut away, of the structure of FIG. 8 in a closed and sealed position;

FIG. 10 is a sectional view taken on line 10—10 of FIG. 9;

DESCRIPTION OF THE PREFERRED EMBODIMENTS

Figure 1:
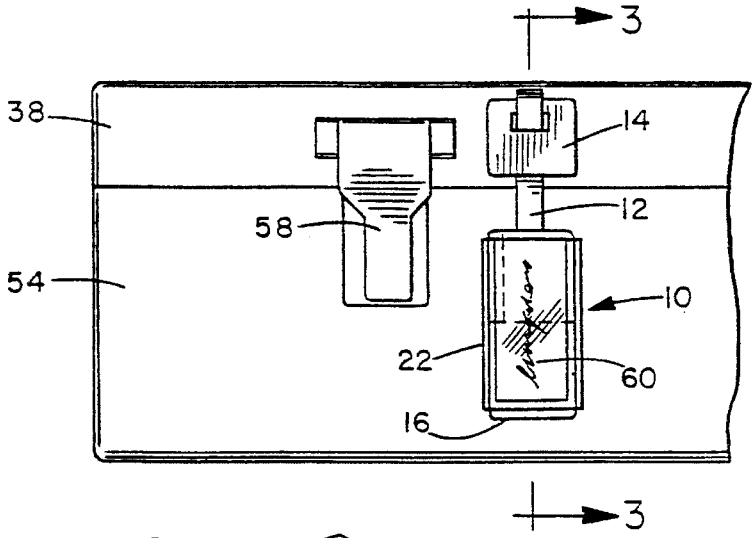
FIG. 1 is a front view of a portion of a briefcase or the like with the tamper indicator according to a first embodiment of the invention attached.
Figure 2:
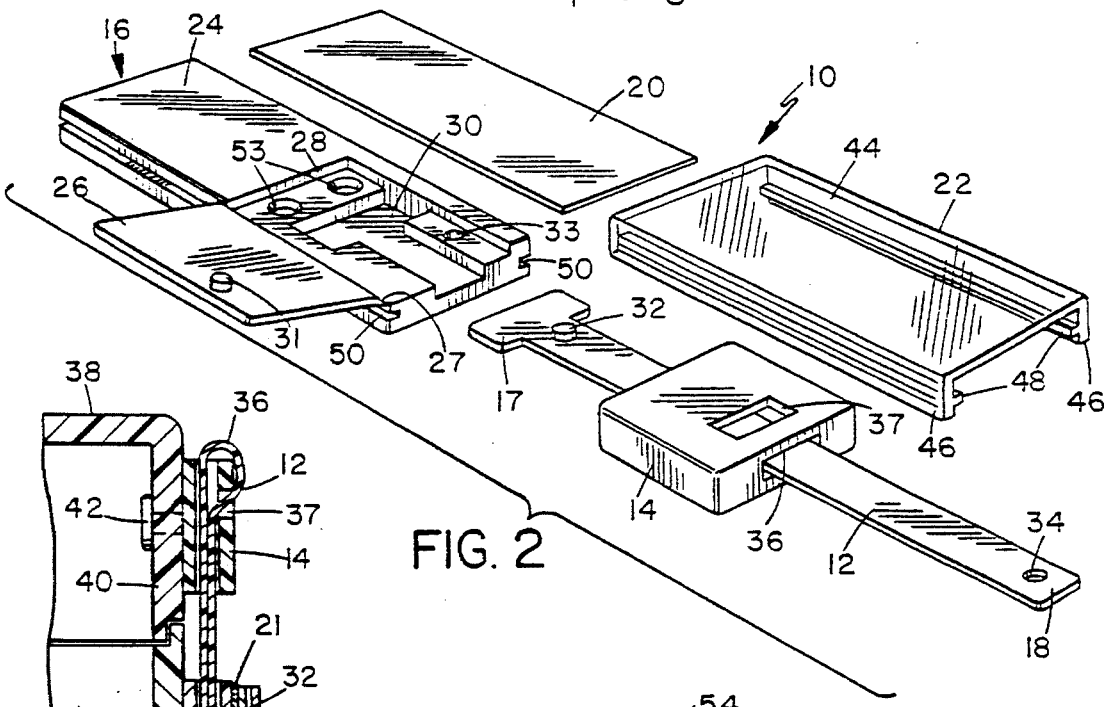
FIG. 2 is an exploded view of the components of the tamper indicator.

FIG. 2 of the drawings illustrates a tamper indicator 10 according to a first embodiment of the invention, while FIGS. 1, 3 and 4 and FIG. 5 illustrate two alternative ways of using the indicator 10.

The tamper indicator 10 of FIG. 2 basically comprises a security strap 12, a loop or channel unit 14 through which the strap 12 extends, and a base unit 16 for trapping the ends 17, 18 of the strap 12. The indicator 10 also includes a supply of labels 20 of the type described in my co-pending application Ser. No. 07/930,731 referred to above, the contents of which are incorporated herein by reference, and a removable transparent cover 22 for the base unit 16. Only one of the labels 20 is illustrated in FIG. 2, but it will be understood that a supply of blank labels will be provided with the other components of the tamper indicator. Each label has a contact adhesive backing layer 21 which will be covered by a peel-off layer (not illustrated) prior to use.

The base unit 16 has a flat top wall 24 including a movable lid or cover portion 26 which is hinged along one edge 27 to the remainder of the unit 16 and separated from the remainder of wall 24 along dividing line 28. Movable cover portion 26 is illustrated in an open position in FIG. 2, revealing a T-shaped recess 30 in the base unit for receiving the correspondingly T-shaped end 17 of strap 12. Thus, movable cover portion 26 provides access to recess 30. The cover portion or lid 26 has a suitable strap fastener mechanism, such as snap button 31, for releasable snap engagement with a mating fastener, such as snap opening 33 to receive button 31 on the edge of recess 30.

Figure 3:
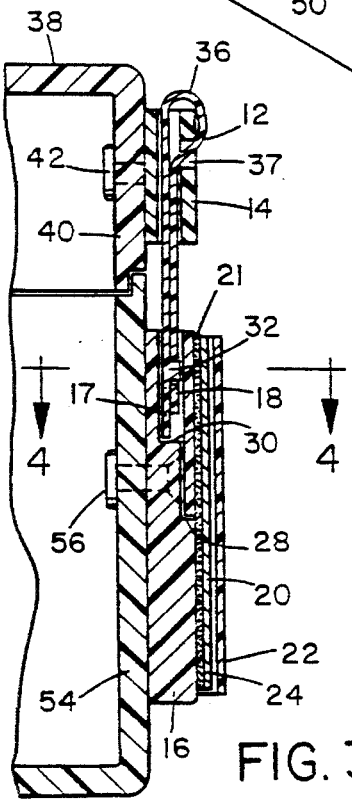
FIG. 3 is an enlarged sectional view taken on line 3—3 of FIG. 1.

End 17 of strap 12 has an upstanding boss or pin 32 and the opposite end 18 of the strap has an opening 34 for engagement over pin 32 so that both ends of the strap can be held together in the recess 30 when the portion 26 is snapped closed, as illustrated in FIG. 3. When portion 26 is closed, it forms a flat surface with the remainder of wall 24 for receiving the label 20, which may be secured across wall 24 including the closed cover portion 26 via the adhesive backing layer of the label.

The channel unit 14 comprises a block having a through bore or channel 36 through which the belt 12 can be threaded, and is adapted for mounting on one part of a case or other container such as the lid 38 of a suitcase or briefcase, for example, as illustrated in FIGS. 1 and 3. Unit 14 has a slot 37 on its upper wall for doubling the belt back through channel 36, as illustrated in FIGS. 1 and 3. The unit 14 is secured to the downwardly depending rim 40 of the lid 38 via screws or rivets 42, as best illustrated in FIG. 3. Unit 14 may alternatively comprise a ring or loop member through which the belt can be threaded, in other arrangements. A zipper opening, ring or loop already provided on a case may be used in place of unit 14, if present.

The cover 22 is of transparent material and has a flat upper surface 44 and downwardly depending side rims 46 extending along opposite side edges of surface 44. Rims 46 have ribs 48 on their inner faces for sliding engagement in grooves 50 provided in the opposite side edges 52 of the base unit 16. The cover 22 may alternatively be hinged at one end or side to the base and be designed for snap engagement over the base unit 16.

Figure 4:
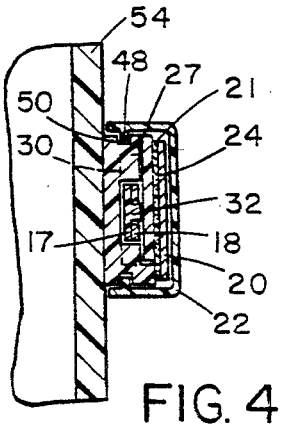
FIG. 4 is a sectional view taken on line 4—4 of FIG. 3.

The base unit 16 preferably has openings or holes 53 in its part which is normally covered by movable cover 26 and can be mounted on the other part of a case, such as on the side wall 54 of the base of a suitcase as illustrated in FIGS. 1, 3 and 4, via rivets 56 extending through openings 53 and corresponding openings provided on the side wall of the case. The base unit is mounted on the base in alignment with the channel unit 14, as illustrated in FIG. 1.

The base unit and channel or loop unit can be made of any suitable material such as plastic or metal which may match the latches 58 of the suitcase or briefcase, while the strap is of any suitably strong material which can be customized in length by the user. Thus, strap end 18 may be provided with a series of spaced holes 34 so that the length can be adjusted while still leaving a hole for snap engagement over pin 32. Where base unit 16 is of plastic, hinge 27 is formed integrally by a thin web of plastic along the length of movable cover portion 26. If the base unit is of metal, a two-part hinge will be used. Once the base and channel units have been mounted as illustrated in FIG. 1, the tamper indicator is ready to use.

When a suitcase or briefcase owner wants to secure the contents of the suitcase or other case, for example when the case is in transit or left in a hotel room or elsewhere, they first thread one end of the belt through the channel unit 14. The ends are then trapped in recess 30, and the cover 26 is snapped closed over the trapped ends. At this point, label 20 is adhesively secured across the closed cover 26 and the remainder of the top wall 24 of the unit, effectively securing cover 26 in its closed position where the belt ends are trapped. The owner then applies personal indicia such as a signature 60 to the label. Transparent cover 22 is then engaged on the base unit 16 to cover and protect the label, leaving the signature 60 visible, as illustrated in FIG. 1.

Once the tamper indicator 10 has been set up as illustrated in FIGS. 1, 3 and 4, no one can open the case without first releasing strap 12 from the base unit 16, or else cutting the strap. In the latter case, tampering will be immediately evident. In the former case, tampering will also be evident since the only way in which the strap ends 17, 18 can be released from the trapping device (recess 30 and cover portion 26) is by opening the cover portion 26. Since cover portion is secured closed by the label 20, it cannot open without first tearing off or destroying label 20. The adhesive backing of label 20 will be such that the label 20 cannot be pulled up and subsequently reapplied. Thus the adhesive is strong enough to adhere firmly to the underlying surface so that it cannot be peeled off in one piece without tearing the label. In the unlikely event that the label is peeled off in one piece, the adhesive backing will be damaged, making it impossible to stick the label back down properly after opening the case. The person opening or tampering with the case will not be able to replace label 20 with a new label after opening the case, since he or she will not be able to duplicate the owner's signature 26. Thus, the tampering will be immediately evident to the owner when he or she sees the torn or forged label through the tamper indicator 10.

This system will be particularly useful when travelling, for example, since owners will be able to tell immediately whether their cases have been opened in transit. Also, it can be used whenever a case is left somewhere, such as a hotel room, and the owner wishes to protect the case contents. It will deter unauthorized opening of cases and other containers since individuals will be less likely to open the case or container when they realize that they cannot conceal the fact that the case has been opened. This is particularly true where only certain individuals would have had access to a case or container, such as when a suitcase is in transit on an airline, for example.

Figure 5:
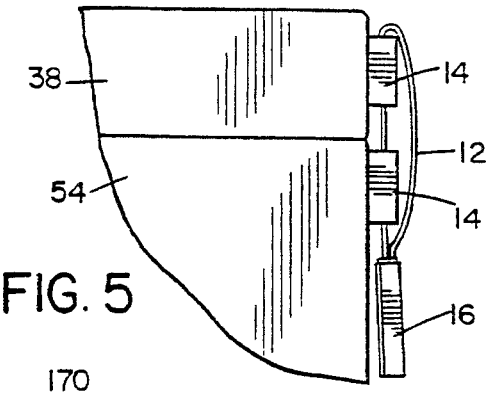
FIG. 5 is a sectional view illustrating a modified arrangement of the tamper indicator using two channel units with the base unit hanging free.

FIG. 5 illustrates a modification of the tamper indicator of FIG. 2, in which two loop or channel units 14 are used instead of one, allowing the base unit 16 to hang free, supported by the strap. In this arrangement, one channel unit 14 is secured to one side of a closure, such as the lid 38 of a case, while the other channel unit 14 is secured to the other side, such as the body or base of a suitcase or other type of case. The strap 12 is then extended through both units 14 and the strap ends trapped in base unit 16 exactly as described above in connection with FIGS. 1–4. The base unit therefore hangs free in this case, suspended by strap 12, and the strap length is such that the case cannot be opened without releasing the strap ends, in turn destroying the personalized tamper indicating label.

The tamper indicator can be installed readily on any type of case or container on assembly, or may be retro-fitted on any type of case. It may also be used on other containers or enclosures for holding sensitive, private or valuable items, such as dresser drawers, filing cabinets, jewelry boxes, cupboards, diaries, books, supply room doors and the like. All that is necessary is that a loop or channel unit be secured to one or both sides of a closure, lid, panel or door of an item or enclosure and the base unit either be secured to the other side or hanging free if two loops or channel units are used, as in FIG. 5, so that the belt extends across an edge of the closure when trapped.

When used on furniture, such as a desk drawer, channel units 14 may be secured on the inside of the drawer frame and drawer, respectively, so as not to detract from the external appearance of the furniture. Strap 12 can be pulled through units 14 with the drawer open, and the drawer is then closed so that the ends hang free on the outside of the drawer. End 18 is then customized in length and trapped with end 17 in base unit 16, so that the drawer cannot be opened without releasing the strap ends from the base unit.

The tamper indicator 10 may also readily be used on any type of case or container having a zipper fastener, without needing the channel member 14 or any mounting of the base unit on the case or container, as illustrated in FIGS. 6 and 7. FIG. 6 illustrates a case 62 having a zipper fastener 64 with a pull tab 66 having a conventional eyelet 68. As is conventional on some cases with this type of fastener, a ring or eyelet 70 is provided at the closed end of the fastener 64 for securing to the pull tab eyelet 68 via a conventional padlock, for example, in order to lock the case. Such fasteners are provided, for example, on some types of suitcases, suit bags, sports bags, rucksacks, and many other types of bags.

The tamper indicator 10 may easily be used on any type of bag having a zipper fastener 64 of the type illustrated in FIG. 6, simply by threading strap 12 through the zipper tab eyelet 68 and end ring 70, and then trapping the ends 17, 18 in the base unit 16 in the same way as illustrated in FIGS. 3 and 4. The cover portion 26 of the top wall 24 is then closed over the trapped strap ends, and a label 20 is adhered across cover portion 26 and the remainder of the wall 24. The user then applies signature 60 and engages transparent cover 22 over the base unit to cover the label. Thus, this does not require any retro-fitting or mounting on the case itself, and provides a very convenient means for deterring unauthorized opening of the case.

Whenever the owner wishes to open the case, they simply tear off label 20 and release the strap. The strap ends are again threaded through eyelet 68 and end ring 70 when the case is re-closed, and trapped in the base unit before applying a new label. The owner will have a supply of labels 20 for convenient use each time the case is opened.

FIG. 7 illustrates another conventional zipper fastener 69 in which two zipper pull tabs 71 are provided and are pulled together in order to close the zipper. When the zipper is closed, the pull tabs will meet. The strap 12 can then be threaded through the eyelets of both pull tabs and then trapped in the base unit 16. The zipper pull tabs cannot then be pulled apart to open the case or bag without releasing the strap.

FIGS. 8–10 illustrate a base unit 72 and strap 74 of a modified tamper indicator according to another embodiment of the invention. The base unit 72 and strap 74 may be used with one or two channel units 14 of the previous embodiment on cases having non-zipper closures, and may be used in an equivalent manner to that illustrated in FIG. 6 or 7 on any case having a zipper fastener.

In the embodiment of FIGS. 8–10, instead of releasably trapping both ends 75, 76 of the strap 74 in the base unit 72, one end 75 is permanently secured to the base unit. Base unit 72 has a lower wall 78 with a recess 80 and spaced side walls 82. A pair of pivotally mounted end flaps 83 form an upper wall of the base unit 72 covering recess 80 when in the closed position illustrated in FIGS. 9 and 10. Each flap 83 is pivotally mounted at a respective end of the base unit via pivots 84 in side walls 82, and the flaps meet along dividing line 85 when closed to form a flat, continuous top wall of the base unit, with each flap forming half of the top wall.

Strap 74 has an enlarged portion at end 75 which is trapped in the recess 80 while the strap extends through an opening 86 in one end of the base unit. The opposite end 76 of the strap has a pair of openings 88 designed to engage over bosses or pins 90 provided in recess 80 when the end 76 is threaded through the opposite end of the base unit and into the recess.

A transparent lid or cover 94 is pivoted at one end to the base unit via pivots 95 for movement between the open position illustrated in FIG. 8 and the closed position in which it extends over the top of the base unit as illustrated in FIGS. 9 and 10. The cover 94 has an upper wall 96 and downwardly depending side rims 97 for fitting over the top and sides of the base unit.

In order to use the tamper indicator of FIGS. 8–10 on a case or other enclosure which does not have a zipper fastener, for example a case with latches as illustrated in FIG. 1, two channel units 14 are first attached to two parts of the case or enclosure as illustrated in FIG. 5. The free end 76 of the strap 74 is then threaded through the bore 36 in each channel unit 14, and then threaded into the base unit recess 80. With flaps 83 in the open position, the holes 88 are placed over bosses 90. The flaps are then closed to trap the strap end 76, and a tamper indicating label 20 is adhered to the closed top wall so as to extend over both flaps, as illustrated in FIGS. 9 and 10. The user then writes their signature on top of the label and closes cover 94. The base unit is then hanging free as in FIG. 5. The strap is then secured across a closure line of the case to prevent opening of the case without first releasing the strap and thus damaging or destroying the label.

In order to use the tamper indicator with a case having a zipper fastener, the owner simply threads the end 76 of the strap 74 through a zipper tab eyelet 68 and end lock ring 70, or two adjoining zippers as in FIG. 7, engages end 76 on the bosses in recess 80, and then closes the flaps to trap the strap end. Again, a personalized security label 20 is applied over the closed flaps to secure them closed, and the owner writes a signature on the label before closing cover 94.

The flaps 83 may also have snap fasteners for snap engagement with mating fasteners on the lower wall, as in the first embodiment. This will hold the flaps closed even if the strap becomes dislodged for some reason, preventing inadvertent damage to the label when simply moving the case, for example. In this case, the label secures the flaps but does not hold them closed, since the snap fastener mechanism will hold the flaps closed.

In either case, no one will be able to open the case without first tearing the label 20 to allow the flaps 83 to be opened so that the strap end 76 can be released. This will make the tampering immediately evident to the owner of the case on their return, and will therefore provide a deterrent to unauthorized opening of the case and tampering with its contents, particularly in situations where only certain identifiable individuals would have had access to the case.

Figure 11:
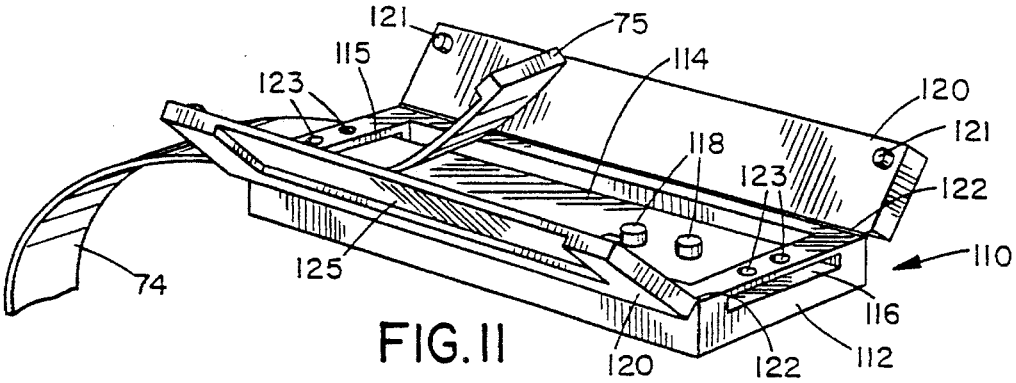
FIG. 11 is a perspective view of a further configuration of the tamper indicator.
Figure 12:
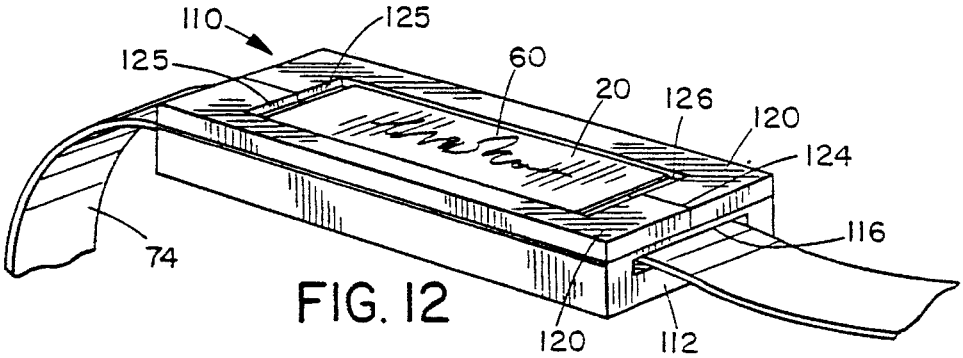
FIG. 12 illustrates the structure of FIG. 11 in a closed and sealed position.

Another modified base unit 110 for a tamper indicator is illustrated in FIGS. 11 and 12. This is similar to that of FIGS. 8–10 and uses an identical strap 74 with enlarged end portion 75 and a pair of openings 88 (not visible in the drawings) in the opposite end of the strap. Base unit 110 has a lower wall 112 with a recess 114, and openings 115, 116 at opposite ends of the recess through which strap 74 can be threaded. The strap is threaded through one end opening 115 with the enlarged end 75 trapped in the recess, as indicated in FIG. 11, while the opposite end is free for threading through a ring or channel unit on a case. A pair of pins or bosses 118 are provided in the recess 114 for engagement with the openings 88 on the strap 74.

A pair of side flaps 120 are hinged along hinge lines 122 on opposite sides of the lower wall 112 and may be closed to form a continuous top wall of the base unit covering the recess 114, as illustrated in FIG. 12. When closed, the side flaps meet along dividing line 124 extending longitudinally along the length of the base unit, unlike dividing line 85 of the previous embodiment which extended transversely across the top of the base unit. Each side flap 120 has a recessed rectangular portion 125 which cooperates with the recessed portion 125 on the other side flap when the flaps are closed to form a flat recessed area 126 of dimensions slightly larger than that of a label 20, as illustrated in FIG. 12. The side flaps preferably have snap buttons 121 for snap engagement in snap recesses or holes 123 on lower wall 112, illustrated in FIG. 11. This snap closure will hold the flaps closed over the trapped strap end.

The tamper indicator of FIGS. 11 and 12 may be used in an equivalent manner to those of the previous embodiments, either in conjunction with one or two channel units 14 or with a zipper pull tab and lock ring, or two zipper pull tabs, or with any ring or loop already provided on a case or container. Again, the free end 76 of the strap 74 is threaded through channel member 14, or through zipper end tab and lock ring in a case having a zipper fastener or where two zippers zip to meet one another as illustrated in FIG. 7. End 76 is then threaded through end opening 116 into recess 114, and the openings 88 are engaged over bosses 118 with the side flaps 120 open. Side flaps 120 are then snapped closed, and a label 20 is adhered to the flat recessed area 126 to secure the flaps. A signature 60 is then applied to the label 20. The transparent cover of the previous embodiments is not essential in this case since the label is recessed and therefore less liable to be damaged, although a cover 22 or 94 as in either of the previous embodiments may be provided for use on the base unit if desired for additional protection.

Again, once the strap end 76 is trapped and the label 20 is applied as in FIG. 12, the end 76 can not be released without first tearing the label 20 or at least destroying its adhesive backing. Thus, the owner of the case is provided with an immediate indication of whether the case has been tampered with in their absence.

Figure 13:
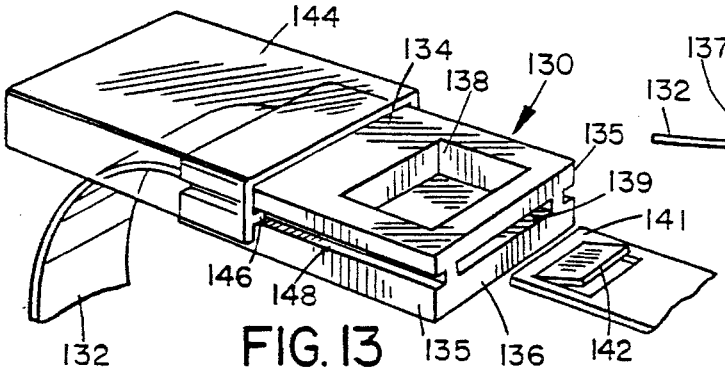
FIG. 13 is a perspective view of another configuration of the tamper indicator.
Figure 14:
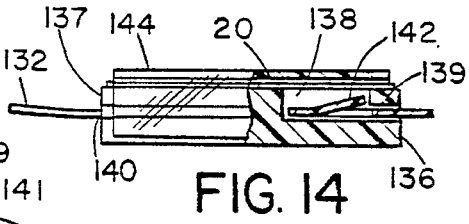
FIG. 14 is a side elevation view, partially cut away, of the structure of FIG. 13 in closed and sealed position.

FIGS. 13 and 14 illustrate another modified base unit 130 and retaining strap 132 which may used in the manner illustrated in FIGS. 1, 3 and 4, 5, 6 or 7, depending on the type of case or container closure. In this embodiment, base unit 130 is a rectangular block having an upper surface 134, side walls 135, and end walls 136, 137. A recess 138 is provided in the upper surface, and end wall 136 has an opening 139 leading into recess 138. One end 140 of the strap 132 is permanently secured to the opposite end wall 137 in any suitable manner, such as adhesive, riveting, or other types of fasteners.

The opposite end 141 of the strap has an upstanding snap lug 142 and is designed to be inserted through the opening 139 into recess 138, with the snap lug first being depressed and then snapping up when it is fully inserted to hold the strap end in the recess, as illustrated in FIG. 12. The snap lug 142 must then be depressed by pushing down on it through the open top of the recess 138 in order to release the strap end. The open top of the recess is therefore covered by a label 20 in order to provide the tamper protection of this device, as indicated in FIG. 12. Label 20 extends across the entire upper surface of the base unit. A slide-on or snap-on cover 144 is provided for covering and protecting label 20. Cover 144 as illustrated is similar to that of the first embodiment and has side ribs 146 for sliding engagement in grooves 148 provided along the side walls 135 of the base unit. Alternatively, a snap-on transparent cover as in FIG. 8 may be used.

It will be understood that the strap and base unit of this embodiment may be used either in the manner illustrated in FIGS. 1, 3 and 4 or FIG. 5 above, in conjunction with one or two suitable channel units 14 or other rings or loops on a case, or in the manner illustrated in FIG. 6 or 7. The free end 141 of the strap is threaded through channel unit 14 or any other suitable loop or ring member on one part of a case, or through a zipper end tab and lock ring or two adjoining zippers, and is then snapped into recess 138 of base unit. Label 20 is then adhered to upper surface 134 across recess 138. A signature 60 may be applied to the label prior to adhering it to the base unit. The cover 144 is then moved over the base and attached label, as illustrated in FIG. 14, in order to protect the label against accidental damage. The base unit is then held by the straps and will hang free.

With this arrangement, the snap fastener cannot be released without tearing or removing label 20, which will then be impossible to reapply and will provide immediate evidence that the device has been tampered with in order to gain access to the case. Although in this embodiment the recess is not provided with a lid or cover flap, as in the previous embodiments, a transparent hinged lid or cover flap may be provided over recess 138 if desired.

Figure 15:
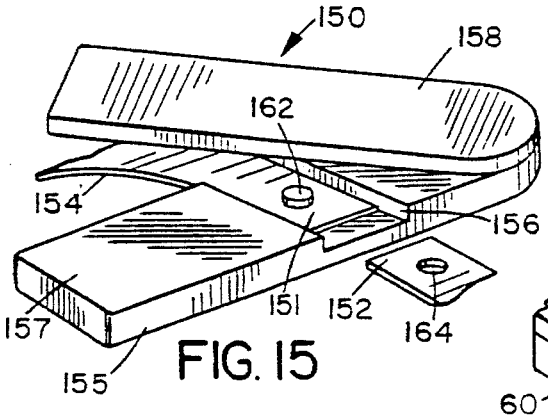
FIG. 15 is a perspective view of a further configuration of the tamper indicator in an open position.
Figure 16:
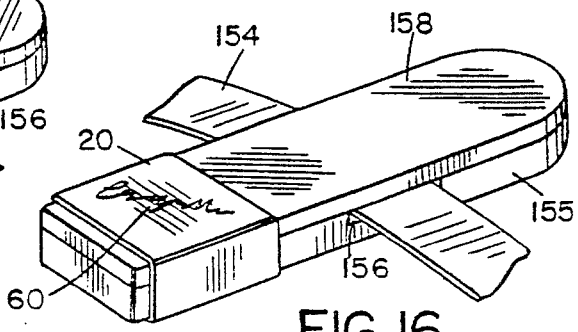
FIG. 16 illustrates the structure of FIG. 15 in a closed and sealed position.

FIGS. 15 and 16 illustrate a base unit 150 and opposite ends 151, 152 of a retaining strap 154 according to another embodiment of the invention. In this embodiment, the base unit 150 has a lower wall 155 having a transverse recess 156, and an upper wall 158 which is pivoted to the lower wall 155 at one end of the base unit about a vertical pivot axis. Instead of pivoting upwardly as in the case of the cover flaps and portions of the previous embodiments, upper wall 158 is pivotally attached so as to pivot or swing sideways about one end of the base unit between the open position of FIG. 13 and the closed position of FIG. 14. In the closed position, upper wall 158 completely covers the recess 156.

Recess 156 has an upstanding boss or pin 162, and each end of the strap has a corresponding opening 164 for engaging over pin 162 with the upper wall 158 in the open position. The upper wall 158 can then be closed to trap the strap ends in the recess. A label 20 is then wrapped transversely around the free end of the upper wall and the underlying end of the lower wall, securing the upper wall in its closed position and preventing opening of the upper wall without destroying or tearing the label. The user can write a signature 60 across the label before wrapping it around the base unit, providing an effective tamper indicator.

The base unit and strap may be used in an equivalent manner to the previous embodiments, by extending the strap through suitable channel units or other rings or loops secured to each opening part of the case, for example, and trapping the strap end or ends in the base unit as described above. The base unit will then hang freely on the straps. It may also be used as in FIG. 6 or 7 with any case, bag or container having a zipper fastener, and the base unit will again hang freely from the case, suspended by the strap. Instead of threading the strap through the rings, loops or channel units on the case, one end of the strap may instead be secured to one part of the case while the other end is releasably trapped in the base on another part of the case or container, with the strap extending across a closure line of the case or container and thus preventing opening of the container without releasing the trapped end of the strap. Once the tamper indicating label has been applied and personalized, the case or container cannot be opened without first releasing the strap from the base unit, and this cannot be achieved without tearing or destroying the label, making the tampering immediately evident to the owner.

Figure 17:
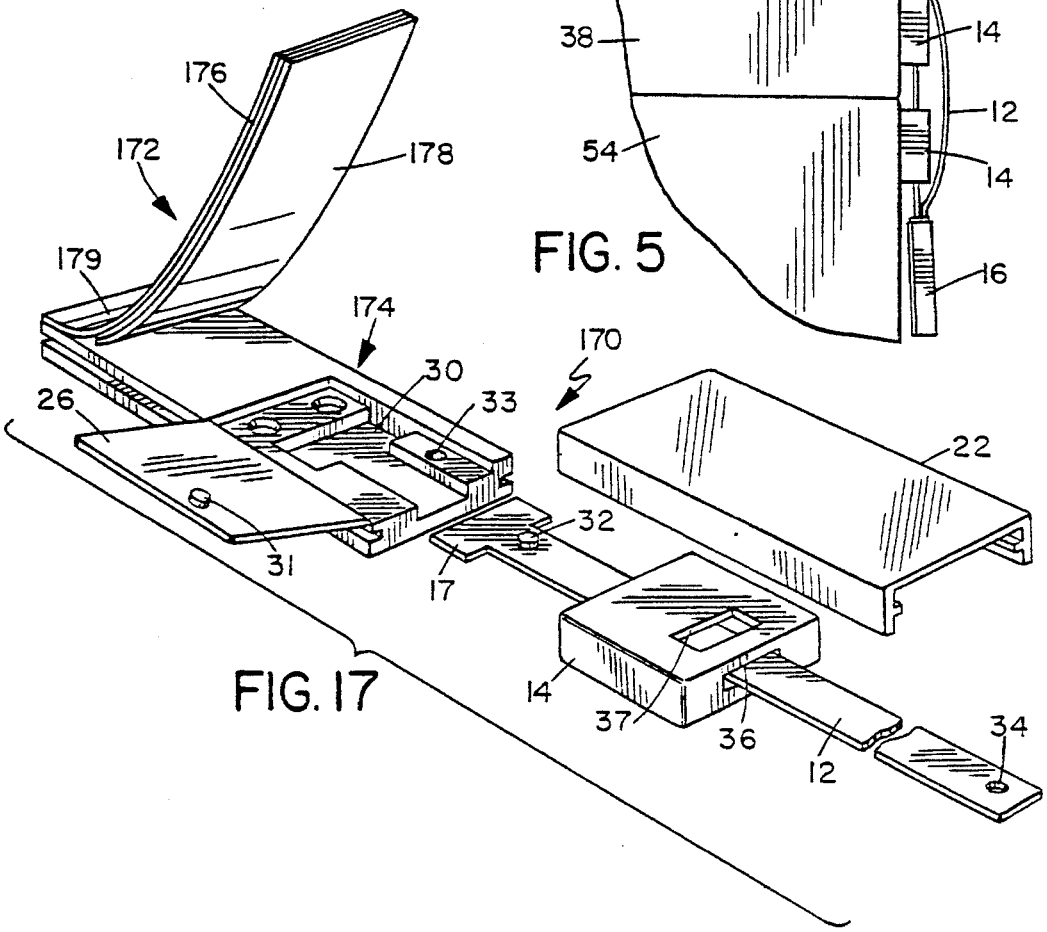
FIG. 17 is an exploded view of the components of an alternative embodiment of the tamper indicator.

FIG. 17 illustrates a tamper indicator 170 according to another embodiment of the invention in which the separate paper labels 20 of the previous embodiments are eliminated, and replaced with a reusable tamper indicating label 172 permanently secured to base unit 174. The other parts of tamper indicator 170 are identical to those of FIG. 2, and like reference numerals have been used as appropriate for like parts.

Base unit 174 is similar to the base unit 16 of the first embodiment and like reference numerals have been used for like parts. However, reusable tamper indicating label 172 is secured at one end to one end of the upper wall 24 of base unit 174. Label 172 is of length equivalent to that of base unit 174, and comprises a multi-layer strip having a base or host layer 178 carrying a coating 176 of imprinting medium such as grease, ink or the like, and an upper transparent or translucent layer 179. This is equivalent to the tamper indicating label as described in my co-pending application Ser. No. 07/946,183 filed Sep. 16, 1992, the contents of which are incorporated herein by reference. Thus, if the cover portion 26 of base unit 174 is snapped closed over the trapped ends of strap 12, and label 172 is laid flat over the top of wall 24, the user can apply personalized indicia to the label by applying pressure to upper layer 179 with a pencil stylus or other tip. This produces a temporary bond between the grease and the upper layer at the location of pressure application, in the manner of a so-called "grease pencil" pad. The user can therefore "write" a temporary signature onto the label 172.

This device is used in exactly the same way as the tamper indicators of the previous embodiments up to the point at which the indicator label is applied to the base unit. Thus, it may be used in the manner illustrated in FIGS. 1, 3 and 4, FIG. 5, FIG. 6 or FIG. 7 to secure a container or item closed. Once the cover portion 26 is snapped closed over the trapped strap ends, the user imprints a signature onto the label 172, and closes the transparent cover 22 over the label and base. The signature will remain undisturbed as long as the cover is in place. However, if anyone removes the cover in order to open the case, the label will be disturbed and the layers will tend to separate, partially or completely obliterating the signature.

Figure 18:
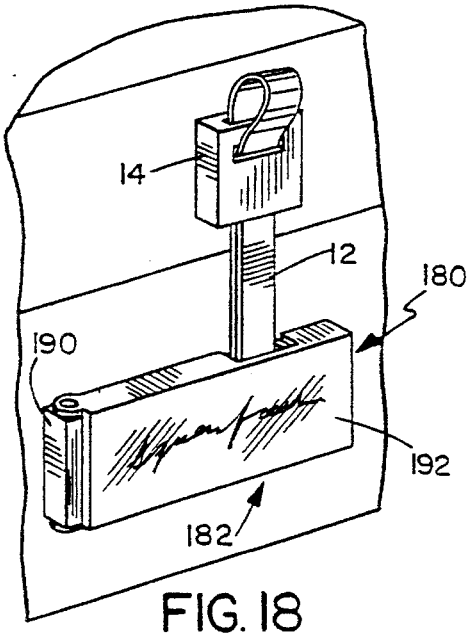
FIG. 18 is a front view of a portion of a briefcase with a tamper indicator according to another embodiment of the invention.
Figure 19:
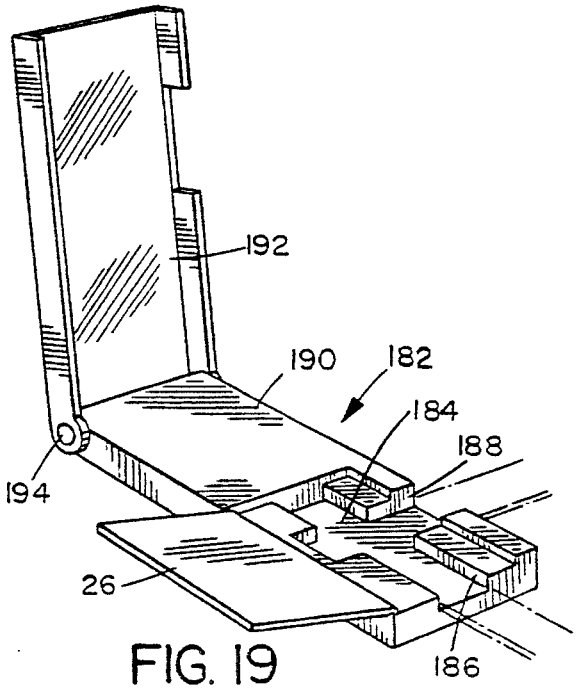
FIG. 19 is a perspective view of the tamper indicator of FIG. 18 in an open position.

FIGS. 18 and 19 illustrate a modified tamper indicator 180 which is similar to that of FIG. 2 but which is modified to allow the strap ends to be secured endwise or transversely to the base unit. Portions of the tamper indicator 180 of FIGS. 18 and 19 are identical to that of FIG. 2, and like reference numerals have been used for like parts as appropriate. Thus, tamper indicator 180 comprises one or more channel units 14, a strap 12, and a modified base unit 182. Base unit 182 is similar to base unit 16 of FIG. 2 apart from the recess 184 which is of a different shape to recess 30 of FIG. 2, and like reference numerals have been used for like parts when appropriate. However, instead of recess 30 having a T-shape with a stem directed through one end of the base unit, as in FIG. 2, recess 184 has two perpendicular, superimposed T-shaped areas, one of which has a stem portion 186 extending out through one end of the base unit, and the other of which has a stem portion 188 extending out through one side 190 of the base unit. Thus, the T-shaped end of the belt can be placed into one T-shaped area to extend out endwise from one end of the base unit, or into the perpendicular T-shaped area and stem portion 188 to extend out from the side of the base unit, as illustrated in FIG. 18. Additionally, instead of slide-on cover 22 as in FIG. 2, the base unit has a transparent cover 192 hinged via hinges 194 at one end of the base unit for closing over the base unit and label.

The tamper indicator as described in any of the above embodiments can be used on any type of case, box or other container or enclosure for restricting access to the contents of the item or container and providing an immediate indication of any unauthorized access. Although use of the indicator on cases such as suitcases, briefcases and other bags is described above, it will be understood that it may also be used on boxes, pieces of furniture such as filing cabinets, chests of drawers, cupboards, books and folders, or the like, and any other item having a movable closure.

In order to use the device to indicate opening of a drawer, for example, all that is necessary is that the base be applied to any rigid surface adjacent the drawer or opening, and the strap be looped through the drawer or door handle, or a channel unit applied to the drawer or door, and then trapped in the base unit. Alternatively, two loops or channels may be applied, one to the drawer and one to any adjacent surface, and the strap may then be looped through both channel units and trapped in the base unit which will hang free. A personalized label is then applied to the base unit. The drawer or door cannot be opened without first releasing the strap end or ends from the base unit, which will in turn require removal and tearing of the label. It will be understood that the flat strap of the illustrated embodiments may be replaced by any type of elongate connecting member, such as a line, chain, or the like.

In order to use the device on a book, diary, folder or the like, a base unit or loop is applied to one cover and a second loop or channel unit is applied to the other cover. The strap can then be extended through the loops or each channel unit, across the closure opening and trapped in the base unit before applying the tamper indicating strip or label.

Such tamper indicators may be provided as accessories for use with bags or cases with zipper fasteners, and may be easily mounted on cases or containers which do not have zipper fasteners, as described above in connection with FIGS. 1, 3 and 4. New cases may be manufactured with tamper indicators matching the other fittings on the case, and tamper indicators can be readily retro-fitted on existing cases. Other information can be imprinted on the base unit, such as the owner's name and address. This provides owners with an easy method of deterring unauthorized opening of their cases or other containers, since such opening will be immediately apparent from the state of the tamper indicator. The system is particularly useful where only a few, easily identifiable individuals have access to an unattended bag, container or other item.

Although some preferred embodiments of the invention have been described above by way of example only, it will be understood by those skilled in the field that modifications may be made to the disclosed embodiments without departing from the scope of the invention, which is defined by the appended claims.

I claim:

1. A tamper indicating security device, comprising:

an elongate, flexible connecting member for securing to one part of a case or container, the connecting member having at least one free end;

a base unit having trapper means for receiving and trapping the free end of said connecting member, and access means for accessing to said trapper means;

a tamper indicating label having a securing means for securing the label to the base unit in a position extending across the access means so that the trapper means cannot be accessed without first moving said label, the label being of predetermined dimensions for receiving personal indicia applied by a user, and comprising tamper indicating means for altering the appearance of said label in the event of moving the label;

the access means comprising a cover portion movable between a closed position covering said trapper means and an open position allowing access to said trapper means, and the label comprising means for extending over at least part of said cover portion and an adjacent portion of said base unit to hold said cover portion closed.

2. The device as claimed in claim 1, wherein said securing means comprises an adhesive backing layer on said label, the label and backing layer together comprising said tamper indicating means whereby said label cannot be removed from said base unit without tearing or damaging said label.

3. The device as claimed in claim 1, wherein said tamper indicating label comprises a base layer and an upper layer of at least partially transparent material secured at least at one end to the base layer, said tamper indicating means comprising an imprinting medium between said base and upper layers, the imprinting medium comprising means for forming visible indicia when pressure is applied to said upper layer and for altering said indicia when said label is moved, said label having a first end secured to said base unit and being adapted to be laid across said access means of said base unit to receive personal indicia.

4. The device as claimed in claim 1, wherein the base unit has a recess for receiving at least one end of said connecting member, said recess comprising said trapper means.

5. The device as claimed in claim 4, wherein the base unit has a label-receiving surface for receiving said label, and the label-receiving surface has an opening comprising said access means for accessing said recess to release said connecting member from said recess, said opening being secured by said label.

6. The device as claimed in claim 1, further including at least one channel unit for securing to one part of a case or container, the channel unit having a through bore for receiving said connecting member so that said connecting member extends through said channel unit.

7. The device as claimed in claim 6, including two channel units, one channel unit for securing to one part of an item to be secured, and the other channel unit for securing to another relatively movable part of an item to be secured, whereby the connecting member can be extended through both channel units and secured to the base unit with the base unit hanging freely from the connecting member.

8. The device as claimed in claim 1, wherein the opposite end of said connecting member is secured to said base unit and the connecting member comprises means for extending through a loop on one part of a case or other container or through two loops, two zipper pull tabs, or a zipper pull tab and end lock ring, so that the connecting member cannot be released from the case without first releasing at least one end of the connecting member from the base unit.

9. The device as claimed in claim 8, wherein said opposite end is releasably secured to the base unit and the trapper means comprises means for releasably trapping both ends of the connecting member.

10. The device as claimed in claim 8, wherein said trapper means comprises means for releasably trapping only said one end of the connecting member.

11. The device as claimed in claim 1, wherein said one strap end and trapper means include interengageable formations for releasably retaining said free end in said trapper means.

12. The device as claimed in claim 11, wherein said base unit has a recess for receiving at least said one free end, said interengageable formation being provided in said recess.

13. The device as claimed in claim 12, wherein said recess has at least one boss and said one free end has at least one opening for engagement over said boss via said access means, said boss and opening comprising said interengageable formations.

14. The device as claimed in claim 12, wherein said recess is T-shaped and said one free end is of corresponding T-shape for engagement in said T-shaped recess, said T-shaped recess and free end of said connecting member comprising said interengageable formations, and said label comprising means for trapping said free end in said T-shaped recess when applied to said base unit.

15. The device as claimed in claim 14, wherein said base unit has opposite end walls and side walls, and said recess has two, superimposed and perpendicular shaped areas, one of said T-shaped areas extending out through one end wall of said base unit to receive said T-shaped strap end in a first orientation, and the other T-shaped area extending out through one side wall of said base unit for receiving said T-shaped strap end in a second, perpendicular orientation.

16. The device as claimed in claim 14, wherein said recess comprises means for trapping opposite ends of said connecting member in said base unit with the remainder of the connecting member looped through a ring or channel member on part of a case or container.

17. The device as claimed in claim 12, wherein said interengageable formations comprise a snap fastener mechanism.

18. The device as claimed in claim 1, wherein the base unit has a recessed, label-receiving area for receiving said label.

19. A tamper indicating security device, comprising:

an elongate, flexible connecting member for securing to one part of a case or container, the connecting member having at least one free end;

a base unit having a recess for receiving and trapping at least the free end of said connecting member, and access means for accessing said recess;

a tamper indicating label having a securing means for securing the label to the base unit in a position extending across the access means so that the recess cannot be accessed without first moving said label, the label being of predetermined dimensions for receiving personal indicia applied by a user, and comprising tamper indicating means for altering the appearance of said label in the event of moving the label;

the base unit having a label-receiving surface for receiving said label, and the label-receiving surface having an opening for access to said recess to release said connecting member from said recess, said opening being secured to said label; and a lid for covering said recess in a closed position, said lid forming part of said label-receiving surface in said closed position.

20. The device as claimed in claim 19, including interengageable snap fastener means on said lid and said base unit for releasably retaining said lid in a closed position.

21. A tamper indicating security device, comprising:

an elongate, flexible connecting member for securing to one part of a case or container, the connecting member having at least one free end;

a base unit having a recess for receiving and trapping at least the free end of said connecting member, access means for accessing said recess;

a tamper indicating label having a securing means for securing the label to the base unit in a position extending across the access means so that the recess cannot be accessed without first moving said label, the label being of predetermined dimensions for receiving personal indicia applied by a user, and comprising tamper indicating means for altering the appearance of said label in the event of moving the label; and the base unit having a label-receiving surface, the label-receiving surface including at least one movable cover portion for at least partially covering said recess in a closed position and movable into an open position allowing access to said recess, said cover portion comprising said access means, and, on application to said label-receiving surface, said label preventing opening of said cover portion without tearing said label.

22. The device as claimed in claim 21, wherein said label-receiving surface includes a fixed portion adjacent said recess and said movable cover portion is separated from said fixed portion along a dividing line when in said closed position forming a substantially continuous label-receiving surface, said label extending over said dividing line to prevent opening of said cover portion when applied to said label-receiving surface.

23. The device as claimed in claim 21, wherein said label-receiving surface comprises a pair of movable cover portions movable between a closed position in which the cover portions completely cover said recess and form a substantially continuous label-receiving surface with the cover portions separated from one another along a dividing line, and an open position allowing access to said recess, said label extending over at least part of said dividing line to prevent opening of said cover portions when applied to said label-receiving surface.

24. A tamper indicating security device, comprising:

an elongate flexible connecting member for securing to one part of a case or container, the connecting member having at least one free end;

a base unit having a recess for receiving and trapping at least the free end of said connecting member, access means for accessing said recess;

a tamper indicating label having a securing means for securing the label to the base unit in a position extending across the access means so that the recess cannot be accessed without first moving said label, the label being of predetermined dimensions for receiving personal indicia applied by a user, and comprising tamper indicating means for altering the appearance of said label in the event of moving the label; and a removable, transparent cover member for covering said base unit and label when applied to said base unit.

25. A tamper indicating security device, comprising:

a security strap for extending through a loop on one part of a container or case, through loops on two parts of a container or case, through two zipper pull tabs or through a zipper pull tab and end lock ring, the strap having opposite first and second ends;

a base unit having a recess for receiving at least the first end of the strap, an access opening for access to said recess, and a movable cover portion for removably covering at least part of said access opening in a closed position and allowing access to said recess through said opening in an open position, the first end of the strap and the recess having interengageable formations for releasably securing the strap end in the recess, the formations being engageable and releasable only via said access opening; and a tamper indicating label for securing across at least part of said cover portion and an adjacent portion of the base unit with the cover portion closed to prevent access to the cover portion in the closed position unless the label is torn or removed, the label being of predetermined dimensions for receiving personal indicia applied by a user, and including tamper indicating means for altering the appearance of the label or indicia if the label is moved.

26. A method of providing a tamper indication on an item having a movable closure, comprising the steps of:

attaching a retaining strap to extend from one part of the item to the movable closure;

trapping at least one end of the retaining strap in a base unit having a recess for releasably trapping said one strap end;

moving a cover portion of the base unit from an open position into a closed position covering the recess;

adhesively securing an adhesive label across at least part of the cover portion and an adjacent portion of the base unit so as to hold the cover portion closed and prevent access to the recess without tearing or removing the strip; and applying personalized indicia across the adhesive label, whereby the movable closure cannot be opened without releasing the strap end.

27. The method as claimed in claim 26, including the step of attaching the base unit to one part of the item so that the strap extends across the periphery of the movable closure.

28. The method as claimed in claim 26, including the step of attaching the retaining strap to one of the parts of the item by extending the strap through a loop or ring on said one part.

29. The method as claimed in claim 28, including the step of attaching one end of the strap to the base unit before extending the opposite end through the loop or ring and trapping the opposite end in the base unit.

30. The method as claimed in claim 28, wherein both ends of the retaining strap are trapped in the base unit after extending the strap through the loop or ring.

31. The method as claimed in claim 26, including the step of extending the retaining strap through channel units attached to one part of the item and to the movable closure, respectively, before trapping at least one end of the strap in the base unit and allowing the base unit to hang free, suspended from the item by the strap.

32. The method as claimed in claim 26, wherein the step of attaching the retaining strap to one of the parts of the enclosure comprises extending the strap through at least one zipper pull tab and through another zipper pull tab or a zipper end closure ring, the opposite end of the strap to the trapped end being secured to the base unit, so that the zipper cannot be opened without first releasing the trapped end of the strap from the base unit.

33. The method as claimed in claim 32, wherein the step of trapping at least one end of the strap comprises trapping both ends of the strap in the base unit.

34. The method as claimed in claim 26, wherein the step of applying personalized indicia across the label comprises applying a signature to the label.

* * * * *